United States Patent [19]

Chambers, Sr. et al.

[11] Patent Number: 4,702,422

[45] Date of Patent: Oct. 27, 1987

[54] SOLID WASTE COMMINUTOR WITH SLOTTED SLIDE RAILS AND SIDE RAILS FOR SAME

[75] Inventors: Joseph W. Chambers, Sr.; Jerry R. Nona, both of Santa Ana, Calif.

[73] Assignee: Disposable Waste Systems, Inc., Santa Ana, Calif.

[21] Appl. No.: 909,394

[22] Filed: Sep. 19, 1986

[51] Int. Cl.[4] ..... B02C 23/36

[52] U.S. Cl. ..... 241/46.06; 241/236; 241/291

[58] Field of Search ..... 241/46.06, 46.08, 46.11, 241/46.17, 235, 236, 227, 166, 167, 291, 300.1

[56] References Cited

U.S. PATENT DOCUMENTS 4,046,324 9/1977 Chambers ..... 241/46.06

FOREIGN PATENT DOCUMENTS 298253 11/1965 Netherlands ..... 241/236

*Primary Examiner*—Mark Rosenbaum

*Attorney, Agent, or Firm*—Sughrue, Mion, Zinn, Macpeak, and Seas

[57] ABSTRACT

Two interacting stacks of peripheral overlapping shredding members of disk form are mounted on substantially parallel shafts and positioned transversely to the direction of waste material passing through a comminutor casing. The casing opens upstream and downstream side for introducing liquid borne waste to the chamber and for discharging the comminuted waste therefrom after shredding, respectively. The casing is closed off by a pair of imperforate side rails, each side rail is slotted to form a series of inwardly projecting planar fingers having front edges of circular arc form facing the periphery of the rotating cutting element disks and having a radius larger than the radius of the disks and being spaced slightly therefrom. The array of fingers extend over the complete height of the stack shredding members. This facilitates greater flow of the liquid through the comminution chamber via slots between the fingers, carrying fine solids to enhance comminution.

14 Claims, 4 Drawing Figures

FIG. 2
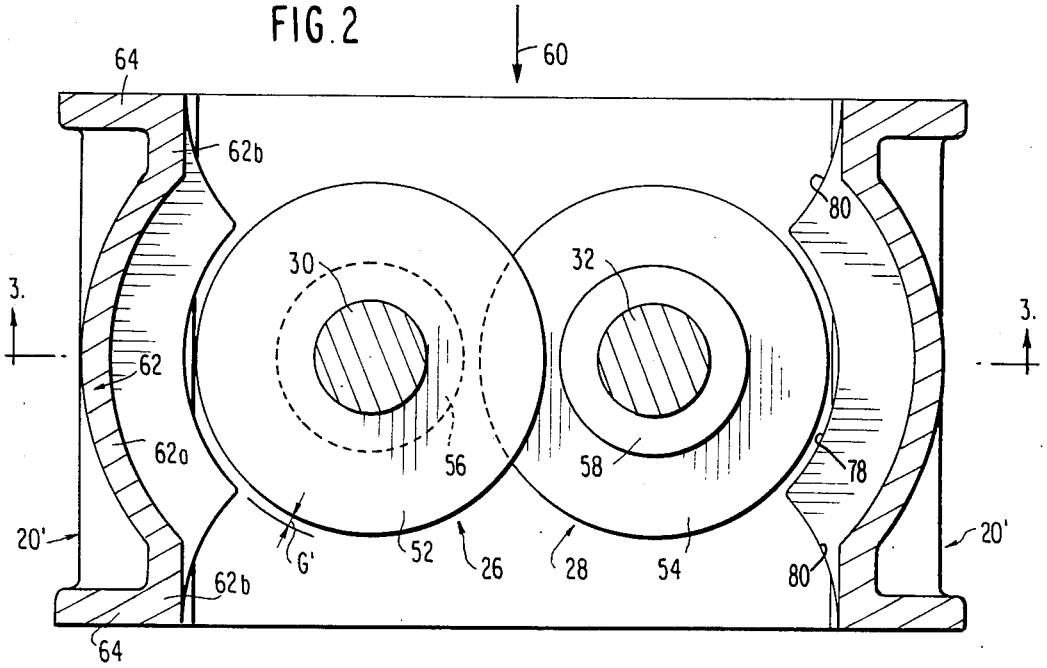
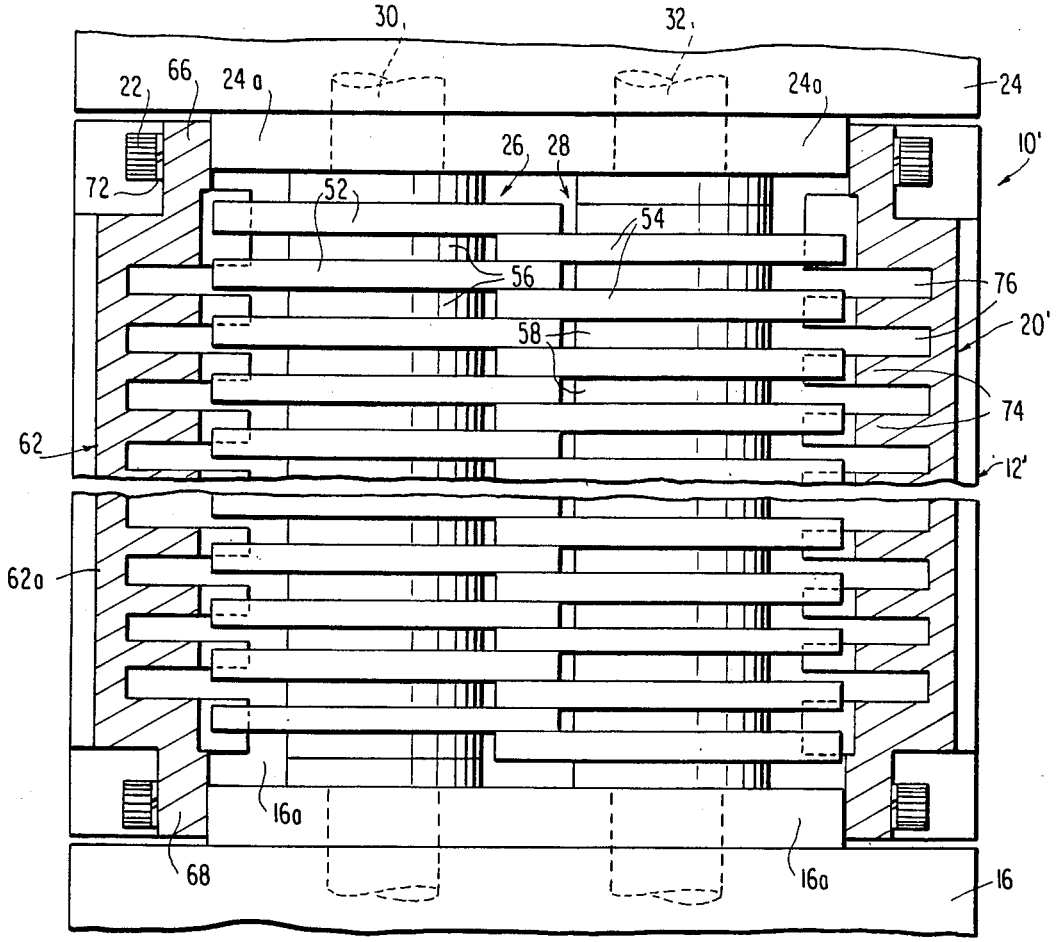
FIG. 3

SOLID WASTE COMMINUTOR WITH SLOTTED SLIDE RAILS AND SIDE RAILS FOR SAME

BACKGROUND OF THE INVENTION

This invention relates to solid waste comminuting apparatus, and more particularly, to a comminutor in which solid waste material is sheared, shredded, and crushed while borne by a liquid such as water by the opposing forces of counter-rotation of peripheral overlapping interacting stacks of shredding elements.

A highly successful commercial solid waste comminutor is set forth in U.S. Pat. No. 4,046,324, to which the present invention has specific application. In general, comminution or the reduction of particle sized solid waste material to minute or fine particles is performed by shearing, shredding and crushing of waste material. Such comminution is performed by feeding solid waste material into the interface of counter-rotating innermeshed cutting elements. Such cutting elements may be of disk form or otherwise having radially projecting cutting teeth which overlap each other during rotation and with the cutting disks being spaced from each other within the given stack by smaller diameter spacers all fixed to respective shafts which extend parallel to each other and which are driven in counter-rotation. Shearing action occurs when the particles of waste material are clipped or cut by "scissors" action between the cutting elements on one shaft and those on the other shaft due to the overlap of root diameters of the cutting teeth carried thereby. Solid particles are sheared by the opposing forces of counter-rotation of the cutting teeth on the different stacks of cutting elements. The particles are also shredded by tearing action of the leading edge of a cutting tooth against solid material trapped between that cutting element and the opposite stack. The movement of the cutting element tooth passing by and through the trapped solid material also serves to crush the waste material.

Preferably, comminution is performed by feeding the solid material through the counter-rotating stacks of cutting elements while entrained in a liquid. Such entrainment not only conveniently achieves transport of the solid material to and through the comminutor, but additionally comminution is thereby aided by the process of maceration. Maceration is the softening and wearing effect of a liquid medium on a solid particle entrained within the liquid.

In U.S. Pat. No. 4,046,324 the stack of rotary disks form cutting elements with each disk spaced from the succeeding disk in the same stack by a smaller diameter spacer disk on the common shaft. Further, the cutting disks are peripherally overlapped at least to the extent of the root diameters of the cutting element teeth radially projecting from the disk proper. Shredding of solid waste material occurs within a comminution chamber defined by a rectangular cross-section casing, through which the axes of the paired shafts bearing the interacting stacks of shredding members or cutters extend.

Referring to FIG. 1 of the drawings, there is disclosed such a comminutor as depicted in U.S. Pat. No. 4,046,324. The comminutor, indicated generally at 10, is particularly useful in comminuting solid waste material borne by a liquid flowing through the interior of a casing indicated generally at 12. The casing forms a comminution chamber 14. The casing 12 is shown in vertical section to illustrate the components of the comminutor and the manner in which they achieve shredding of the solid waste. Purposely, this figure does not show the inlet port or outlet port which are on opposite sidewalls (not shown), into and out of the plane of the paper bearing FIG. 1.

The vertically upright, rectangular, cross sectional casing 12 includes a cast metal base 16 supported by a rectangular plate or cover 18 and bearing, in vertically upright position, a pair of side rails indicated generally at 20. Side rails 20 are connected at their bottoms by screws 22 to an upwardly projecting mounting plate **16*a* of base 16. At the top of casing 12, there is provided a mirror image cast metal casing head or upper frame member 24 of rectangular horizontal cross-section and which terminates, at it's bottom end, in a second mounting plate 24*a*. In similar fashion, further screws 22 project through the top of the side rails and are threaded within tapped holes (not shown) of head mounting plate 24*a***.

In FIG. 1, the vertical side walls of casing 12 are purposely not shown to permit viewing the interior of the casing, however, the casing includes opposed, vertical side walls. For a better understanding and appreciation of the nature in which the casing 12 is completed by such side walls, reference may be had to FIG. 2 of U.S. Pat. No. 4,046,324. One of the opposed side walls carries an inlet port which may be defined by a flange ring carrying a conventional pattern of bolt holes. The opposite side wall includes an outlet port which may likewise be defined by a flange ring through which are drilled bolt holes in a similar common pattern. This permits the comminutor to be mounted within a convention sewage or disposal conduit and the appropriate flange connections use the bolt holes to effect coupling to the sewage or disposal conduit section at opposite sides of the comminutor 10.

As clearly seen in FIG. 1, first and second shredding stacks at 26 and 28 are mounted in mutual, parallel alignment for counter-rotation on drive shaft 30 and idler or driven shaft 32, respectively. Shaft 30 is supported by an upper bearing assembly 34 within head 24 and by a lower bearing assembly 36 within base 16 respective. Shaft 32 is similarly supported for rotation about its axis and parallel to the axis of the drive shaft 30 by upper bearing assembly 38 and lower bearing assembly 40. respectively. In similar fashion to U.S. Pat. No. 4,046,324, the stacks 26, 28 may be compressed between opposing bearing plates (not shown) by nuts 41 on shafts 30, 32 backed by washers 43. The drive shaft 30 includes a drive gear 42 which is in mesh with a similar size driven gear 44 fixed to the upper end of the driven shaft 32. Rotation of the drive shaft 30 effects counter-rotation of shafts 30 and 32 about parallel axes. Drive is effected by an electrical motor indicated generally at 46 powered from an electrical source (not shown) through control box 48. A motor shaft (not shown) of the drive motor 46 is coupled mechanically to drive shaft 30 through a gear reduction unit indicated generally at 50 for driving the comminutor drive shaft 30 at an appropriate RPM suitable to the comminuting of particular solid waste material to which the unit has application.

As previously described, each of the stacks 26, 28 is formed of a number of laminar cutting elements which are preferably of disk form. The cutting elements are directly mounted on the shafts 30, 32. The shafts may be of hexagonal cross sectional configuration with the cutting elements having corresponding holes or openings through the center of the same. The cutting elements 52, 54 are positioned between and separated in the axial direction along respective shafts 30, 32 by laminar spacers 56, 58, respectively, in the form of circular disks of reduced diameter with respect to the cutting elements 52, 54. Preferably the thickness of the cutting elements 52, 54 and the spacers 56, 58 are the same so that the laminar spacers of one stack are coplanar with cutting elements of the other stack. Thus, a cutting element from one stack and a spacer from the other stack form together a pair of interacting shredding members. While cutting teeth (not shown) integral with the cutting elements and projecting radially thereof overlap each other to the extent of their root diameters, there is always a slight gap between the outer periphery of the cutting element teeth of one stack and the periphery of the opposed laminar spacer of the other stack. Insofar as the present invention is concerned, the make up, assembly, and the nature of the drive imparted to the cutting elements herein is identical to that of U.S. Pat. No. 4,046,324.

In that respect, casing 12 is of rectangular parallelepiped form. Side rails 20 are of cast metal construction as are the base 16 and head 24. The side rails are also of rectangular plan configuration with the top and bottom of the side rails being mounted directly to mounting plates 16*a* and 24*a* of the base and upper frame 24, respectively. While the sectional view of FIG. 1 shows the side rails as having their interior surfaces 20*a* which face each other flat, the side rails of the prior art apparatus may take the form shown in U.S. Pat. No. 4,046,324 and include along opposite ends thereof, triangular shaped projections functioning as deflectors for deflecting the flow of solids into the leading edges of the radial cutting teeth projecting outwardly of the periphery of the disk like cutting elements forming the stacks 26, 28 along with the interposed spacers. The comminutor 10 of FIG. 1 as per U.S. Pat. No. 4,046,324 performs quite adequately and constitutes a marked improvement within the art and while it permits the stacks to rotate in either direction due to the presence of cutting edges on both sides of the cutting teeth, thereby providing increased flexibility and a greater length of cutting surface within an increase in the dimensions of the comminutor. However, little attention has been given to the possible adverse action, by the components making up the casing as well as the stacks, to the through put or flow rate of the fluid carrying the solid particles into the comminution chamber and removing of fine particles thereof from the chamber after shearing, shredding and crushing.

SUMMARY OF THE INVENTION

It is therefore an object of the present invention to provide an improved comminutor of the type described above utilizing counter-rotating stacks of cutting elements capable of rotating in either two directions in which the flow rate of liquid through the comminutor is materially increased without comprising the shearing, shredding and crushing capability of the comminutor and without solid material by-passing the shearing, shredding and crushing action of the counter-rotating stacks.

It is a further object of the invention to provide an improved side rail which facilitates the flow of liquid through the comminutor, which improves the deflection of solids carried by the liquid into the path of the counter-rotating cutting element, and which limits the passage of solid material along the side of the cutting element stacks to material of relatively fine particle size.

The invention is directed both to an apparatus for comminuting solid waste material, including a pair of opposed side rails, and the side rails per se for improving such solid waste comminutors. The apparatus for comminuting solid waste material comprises a casing defining a comminution chamber, being open on opposite sides for permitting the flow of liquid therethrough bearing solid waste material and being adapted for connection in a solid waste disposal line. The casing includes an underlying base and an overlying head. A comminutor assembly includes cooperating substantially parallel first and second shredding stacks comprising first and second parallel shafts mounted for rotation at opposite ends within the base and head respectively. Further a plurality of concentric laminar cutting elements are mounted on said first shaft and in innerspaced relationship with the plurality of second laminar cutting elements mounted concentrically on the second shaft. Each cutting element has at least one cutting tooth thereon. The cutting elements are positioned between and separated in an axial direction by laminar spacers which are coplanar with the cutting elements of the adjacent stack such that a cutting element from one stack and a spacer from the other stack form a pair of interactive shredding members. The side rails extend between the base and the head to the outside of respective stacks for controlling the flow of liquid through the comminution chamber from one side to the other and for causing the solid waste to be deflected into the path of rotating cutting elements of the stacks.

The improvement resides in each of the side rails comprising a rear wall extending parallel to the flow direction of the liquid through the comminution chamber with a plurality of planar fingers projecting outwardly of the rear wall in the direction of the stacks aligned with the flow direction of the liquid and being spaced from each other to form slots therebetween. The fingers have arcuate front faces remote from the rear wall, in proximity to the periphery of the rotating cutting elements of the stack proximate thereto and are spaced slightly therefrom so as to define liquid flow passages between the fingers. The fingers are closely spaced such that the flow passages therebetween prevents unsheared solid waste material from passing therethrough with the liquid but permits fine particles of solid waste material to be carried in the entrained liquid for passage therethrough. The effect is to increase the flow rate of the liquid through the apparatus while substantially enhancing the comminution efficiency of the apparatus. Preferably, at least the center portion of each side rail rear wall is arcuate conforming to the curvature of the front edge of the fingers and being concentric thereto such that the fingers define with the arcuate portion of the rear wall, uniform width flow passages for the liquid passing therethrough and about the periphery of the stack. The fingers further comprise arcuate side edges extending from the arcuate front end, at the upstream and downstream ends of the fingers, which taper in the direction of the rear wall to define deflection surfaces for deflecting the flow of solids into the leading edge of the cutting elements for those side edges of the fingers facing in the upstream direction of the liquid flow during use of the apparatus. The side rails may include integral side walls at opposite ends thereof extending generally at right angles to the plane of the side rail rear wall and further integral flat, rectangular mounting bars at right angles to the side walls and at opposite ends of the side walls and spanning across the arcuate center portion of the rear wall to facilitate mounting of the side rails to the head and base of the casing, respectively and to rigidify the structure.

BRIEF DESCRIPTION OF THE DRAWING

FIG. 2 is a horizontal, sectional view of a solid waste comminutor incorporating slotted side rails forming a preferred embodiment of the invention.

FIG. 3 is a vertical sectional view of the comminutor of FIG. 2 taken about line 3—3.

DESCRIPTION OF THE PREFERRED EMBODIMENT

Figure 1:
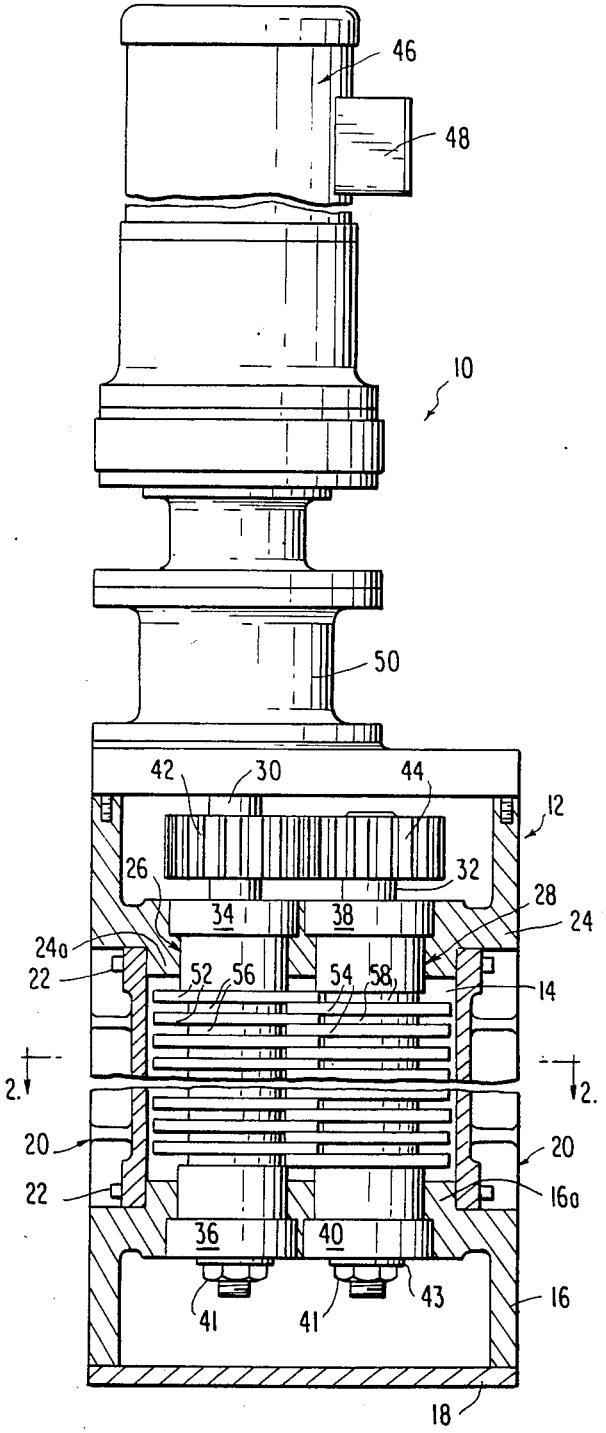
FIG. 1 PRIOR ART
FIG. 1 is a vertical, elevational view of a solid waste comminutor exemplary of the prior art to which the improvement has application with the casing sectioned to show the counter-rotating stacks of cutting elements.
Figure 4:
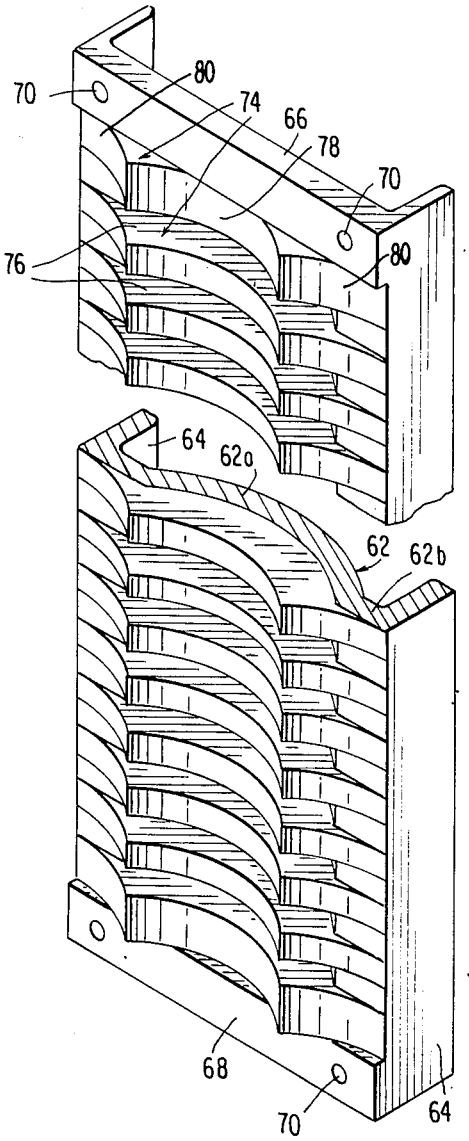
FIG. 4 is a perspective view of one of the improved slotted side rails forming a preferred embodiment of the present invention as employed in the comminutor of FIGS. 2 and 3 and applicable to the prior art comminutor of FIG. 1.

Referring to FIGS. 2, 3 and 4, wherein like elements have like numerical designations to the prior art comminutor of FIG. 1; FIG. 2 is as a horizontal sectional view of the casing portion 12' of a comminutor indicated generally at 10'. The casing 12' includes a base 16. Extending vertically upwardly from the base and on opposite sides thereof are side rails indicated generally at 20' which are mounted outside of stacks 26, 28. Drive shaft 30 and driven shaft 32 support respectively. stacks 26, 28 which are fixedly coupled thereto and which consist of disk like, planar cutting elements 52, 54 separated by smaller diameter disk like planar spacers 56, 58, all fixedly mounted to the shafts 30. 32 respectively by keyways (not shown) or the like. The peripheries of the disk like cutting elements 52, 54 overlap in the same manner as the prior art FIG. 1. Cutting teeth at the peripheries are not detailed. As seen from FIGS. 2 and 3, the side walls of the casing 12' are not shown, but they are essentially identical to the showing in FIG. 2 of U.S. Pat. No. 4,046,324. It is assumed that the flow of liquid bearing the solid waste is in the direction of arrow 60 and through an inlet port (not shown) within the upstream side wall (not shown). The flow of liquid and comminuted solid waste is in the same direction and through the downstream side wall (not shown) and specifically through an outlet port thereof (not shown) of that member.

As may be appreciated, the invention resides in the utilization of side rails 20 for those appearing at 20, in FIG. 1, in the formation of the improved comminutor 10' as well as in the side rails 20' per se as retrofits for such comminutor. FIGS. 2, 3 and 4 show a preferred embodiment of the side rails 20 of cast metal construction. Each side rail 20' is of U-shaped horizontal cross section for structural rigidity. A rear wall indicated generally at 62 consists of a central, arcuate section **62*a* and flat end sections 62*b* to either side. Extending at right angles to the integral flat end sections 62*b* are integral side rail side walls 64. Further, each side rail 20' is provided with squared off upper and lower mounting bars at 66 and 68 which are mirror images of each other. Each mounting bar 66, 68 respectively includes mounting holes 70 passing therethrough to facilitate coupling of the side rails 66, 68 to casing mounting plates 16*a*, 24*a* respectively. These may be identical to those forming a part of casing 12 of the prior art comminutor FIG. 1, via mounting screws 22, FIG. 3. In that respect, a lock washer 72 is positioned between the headed end 22*a* of the screw and mounting plates 66 and 68 of the improved side rail 20'. Tapped holes (not shown) are provided within head mounting plate 24*a* and base plate 16*a***, which holes receive the threaded shanks of the screws.

The significant feature provided by the side rails 20' which contrast them from the structure of FIG. 1, is the inclusion of a plurality of longitudinally spaced, forwardly projecting fingers indicated generally at 74 which form narrow slots 76 therebetween. The fingers are preferably integrally molded into the side rails 20' in the same manner as are the rear walls 62. The fingers conform to the configuration of rear wall 62 and project forwardly therefrom and are planar in form. The thickness of the finger and spacing between the fingers does not have to match the thickness of the cutting elements 52, 54 and the spacing therebetween, defined by spacers 56, 58. In the illustrated embodiment they have like dimensions, however it is noted that the slots 76 and the fingers 74 are offset from the stack cutting elements and spacers of both stacks 26, 28. It is important that the fingers 74 terminate in arcuate front edges 78 whose radius of curvature is slightly larger than the radius of curvature of the cutting elements 52, 54 which these front edges face. while they are spaced from the periphery of the cutting elements by a slight gap indicated at G, FIG. 2. The fingers 74 are also provided with arcuate side edges 80 which function similarly to the triangular shape projections of side rails 51 in U.S. Pat. No. 4,046,324 to deflect the waste solids carried by the fluid passing into the comminution chamber 14 into the leading edges of cutting teeth (not shown) carried by cutting element 52, 54, in respect to the direction of flow.

The utilization of an arcuate center section **62*a* for the rear wall 62 of the side rail is purposely to cause slots 76 to take the form of arcuate flow paths or passages between the fingers of even width in the area of the rotating cutting elements 52, 54 and to significantly increase the throughput of the liquid passing through the comminutor 10'. The relatively close spacing between the fingers 74 (on the order of thickness of the spacers 56, 58 although not necessarily equal thereto) insures that only fine solid waste particles are carried by the liquid passing between the periphery of the cutting elements 52, 54 and within slots 76 between the fingers of the side rails 20'**.

In similar manner to that of U.S. Pat. No. 4,046,324; in operation, solid waste material entrained in a liquid and entering the inlet side of the comminutor 10' in the direction of arrow 60, FIG. 2, contacts the radially projecting cutting teeth of the counter-rotating, intermeshed cutting elements 52, 54 and spacers 56, 58 of stacks 26, 28. The rotating stacks 26, 28 quickly grind the solid waste material into fine particles which are carried by the entrained liquid and discharged on the opposite side of the comminutor 10', FIG. 2. Some particles will be carried by the liquid. whose flow rate is materially increased by the presence of slots 76, through the slots 76 but the slots are purposely sized to prevent solid waste in other than fine particle size as ground by the rotating stacks 26, 28, from passing through the passages defined by the slots 76 in the direction of the casing outlet port.

While the side rails 20' as illustrated in FIGS. 2, 3 and 4 are formed of cast metal, they may be metal stamped. Rather than being unitary, they may be formed of component metal parts welded together, but taking the form shown. Additionally, while the comminutor is shown as having a generally rectangular parallelepiped casing which is elongated transversely the casing could be generally cylindrical and the side rails could be semi-cylindrical in form. They must include a plurality of longitudinally spaced fingers projecting radially toward the periphery of the rotating cutting elements, and positioned transversely outside of the innermeshed stacks of cutting elements. Further the front edges of fingers should arcuate and concave to conform to the periphery of the cutting elements but having a radius of curvature slightly larger than the radius of curvature of the cutting elements at their outer peripheries, and being spaced slightly therefrom.

In contrast to prior designs, the side rails 20', by incorporating slots within the solid metal wall enveloping portions of the rotating stacks over a given circumferential extent, cause considerably more water to pass through the unit from the inlet to the outlet. It should be noted that the fingers defined by the slots do not project internally between the rotatihg disk type cutting elements. This allows the side rails 20' to be used interchangeably with any configuration and thickness of rotating disks. The efficiency of the comminutor 10' is therefore materially increased without a significant increase in head drop.

The results of side rail flow tests on 30008 side rails without the fingers and slots separating same under model designation 30008 and the improved side rail under model designation 31080 for comminutors whose inlet head dimensions are 8, 12 and 18 inches respectively are set forth within the table below showing a flow rate increase averaging about 30 percent for the comminutors using the invention herein. Also. for comminutors having inlet head dimensions up to 60 inches the same average flow rate increases have been observed.

SIDERAIL FLOW TEST
30008 vs 31080

| In Inches | | Side Rails | | |
|---|---|---|---|---|
| Inlet Head | Head Drop | 30008 GPM | 31080 GPM | Flow % Increase |
| 8 | 2 | 87 | 128 | 32.0 |
| 8 | 4 | 114 | 170 | 32.9 |
| 8 | 6 | 128 | 179 | 28.5 |
| 12 | 2 | 152 | 208 | 26.9 |
| 12 | 4 | 189 | 275 | 31.3 |
| 12 | 6 | 219 | 313 | 30.0 |
| 12 | 8 | 252 | 326 | 22.7 |
| 18 | 2 | 263 | 340 | 22.6 |
| 18 | 4 | 300 | 444 | 32.4 |
| 18 | 6 | 382 | 511 | 25.2 |
| 18 | 8 | 412 | 565 | 27.1 |
| 18 | 10 | 444 | 622 | 28.6 |
| 18 | 12 | 460 | 642 | 28.3 |
| 18 | 14 | 494 | n/a | n/1 |

While the invention has been particularly shown and described with reference to a preferred embodiment thereof, it will be understood that by those skilled in the art that various changes in form and details may be made therein without departing from the spirit and scope of the invention.

What is claimed is:

1. In an apparatus for comminuting solid waste material comprising:

a casing defining a comminution chamber and being open on opposite sides thereof for permitting the flow of liquid therethrough bearing solid waste material and being adapted for connection in a solid waste disposal line;

said casing including an underlying base and an overlying head; a comminutor assembly including cooperating substantially parallel first and second shredding stacks comprising: first and second parallel shafts mounted for rotation at opposite ends within said base and said head respectively; a plurality of concentric laminar cutting elements mounted on said first shaft in interspaced relationship with a plurality of second laminar cutting elements mounted concentrically on said second shaft, each of said cutting elements having at least one cutting tooth thereon, said cutting elements being positioned between and separated in an axial direction by laminar spacers which are coplanar with the cutting elements of the adjacent stack such that a cutting element from one stack and a spacer from the other stack form a pair of interactive shredding members, and wherein said casing includes laterally opposed side rails extending between the base and said head to the outside of respective stacks for controlling the flow of liquid through the comminution chamber from one side to the other and for causing the solid waste to be deflected into the path of rotating cutting elements of said stacks;

the improvement wherein each of said side rails comprises; a rear wall extending parallel to the flow direction of the liquid through the comminution chamber, a plurality of planar fingers projecting outwardly of said rear wall in the direction of said stack, aligned with the flow direction of the liquid and being spaced from each other to form slots therebetween, said fingers having arcuate, concave front edges remote from the rear wall in proximity to the periphery of the rotating cutting elements of the stack proximate thereto and being spaced slightly therefrom so as to define liquid flow passages between the fingers, and wherein the fingers are closely spaced such that the flow passages therebetween prevent unsheared solid waste material from passing therethrough with the liquid, but permit fine particles of solid waste material after shredding to be carried in the entrained liquid for passage therethrough, whereby the flow rate of liquid through the apparatus and the comminution efficiency of the apparatus is substantially enhanced.

2. The apparatus as claimed in claim 1, wherein the rear wall of each side rail includes at least a center portion which is arcuate, conforming to the curvature of the front edge of the fingers and being concentric thereto such that the fingers define with the arcuate portion of the rear wall, uniform width flow passages for the liquid passing therethrough and about the periphery of the stack proximate thereto.

3. The apparatus as claimed in claim 1, wherein said fingers further comprise side edges extending from the arcuate, concave front edge at upstream and downstream ends of said fingers which taper in the direction of said rear wall to define deflection surfaces for deflecting the flow of solids into the leading edges of the cutting elements for those side edges of the fingers facing in the upstream direction of the liquid flow during the use of the apparatus comminutor.

4. The apparatus as claimed in claim 2, wherein said fingers further comprise side edges extending from the arcuate, concave front edge at upstream and downstream ends of said fingers which taper in the direction of said rear wall to define deflection surfaces for deflecting the flow of solids into the leading edges of the cutting elements for those side edges of the fingers facing in the upstream direction of the liquid flow during the use of the comminutor.

5. The apparatus as claimed in claim 3, wherein said finger side edges are arcuate in the direction of flow of said liquid through said comminutor.

6. The apparatus as claimed in claim 4, wherein said finger side edges are arcuate in the direction of flow of said liquid through said comminutor.

7. The apparatus as claimed in claim 1, wherein said side rails include integral side walls at opposite ends thereof extending generally at right angles to the plane of the side rail rear wall and wherein said side rails further comprise integral flat, rectangular mounting bars at right angles to said side walls and at opposite ends of said side walls and spanning across the arcuate portion of said rear wall to facilitate mounting of said side rails to said head and base of said casing respectively and to strengthen the side rails.

8. The apparatus as claimed in claim 2, wherein said side rails include integral side walls at opposite ends thereof extending generally at right angles to the plane of the side rail rear wall and wherein said side rails further comprise integral flat, rectangular mounting bars at right angles to said side walls and at opposite ends of said side walls and spanning across the arcuate portion of said rear wall to facilitate mounting of said side rails to said head and base of said casing respectively and to strengthen the side rails.

9. The apparatus as claimed in claim 6, wherein said side rails include integral side walls at opposite ends thereof extending generally at right angles to the plane of the side rail rear wall and wherein said side rails further comprising integral flat, rectangular mounting bars at right angles to said side walls and at opposite ends of said side walls and spanning across the arcuate portion of said rear wall to facilitate mounting of said side rails to said head and base of said casing respectively and to strengthen the side rails.

10. In a side rail for forming part of an apparatus for comminuting solid waste material, said apparatus comprising; a casing defining a comminution chamber and being open on opposite sides thereof for permitting the flow of liquid therethrough bearing solid waste material and being adapted for connection in a solid waste disposal line; said casing including an underlying base and an overlying head; a comminutor assembly including cooperating substantially parallel, first and second shredding stacks comprising; first and second parallel shafts mounted for rotation at opposite ends within said base and said head respectively; a plurality of concentric laminar cutting elements mounted on said first shaft in interspersed relationship with a plurality of second laminar cutting elements mounted concentrically on said second shaft, each of said cutting elements having at least one cutting tooth thereon, said cutting elements being positioned between and separated in an axial direction by laminar spacers which are coplanar with the cutting elements of the adjacent stacks such that a cutting element from one stack and a spacer from the other stack form a pair of interactive shredding members, said side rail forming a portion of said casing extending between the base and said head to the outside of a respective stack for controlling the flow of liquid through the comminution chamber from one side to the other and for causing the solid waste to be deflected into the path of the rotating cutting element of said proximate stack, the improvement wherein said side rail comprises; a rear wall extending parallel to the flow direction of the liquid through the comminution chamber and a plurality of planar fingers projecting outwardly of the rear wall in the direction of said stacks, aligned with the flow direction of the liquid and being spaced from each other to form slots therebetween, said fingers having an arcuate, concave front edge remote from the rear wall in proximity to the periphery of the rotating cutting elements of the stack proximate thereto and being spaced slightly therefrom as to define liquid flow passages between the fingers and wherein the fingers are closely spaced such that the flow passages therebetween prevent unsheared solid waste from passing therethrough with the liquid but permit fine particles of sheared solid waste material carried in the entrained liquid to pass therethrough, whereby the flow rate of liquid to the apparatus and the comminution efficiency of the apparatus is substantially enhanced.

11. The side rail as claimed in claim 10 wherein the rear wall includes at least a center portion which is arcuate, conforming to the curvature of the arcuate, concave front edge of the fingers and being concentric thereto such that the fingers define with the arcuate portion of the rear wall uniform width flow passages for the liquid passing therethrough and about the periphery of the stack proximate thereto.

12. The side rail as claimed in claim 11 further comprising integral side walls at opposite ends thereof extending generally at right angles to the plane of the rear wall and wherein the side rails further comprise integral flat, rectangular mounting bars at right angles to said side wall and at opposite ends of the side walls and spanning across the arcuate portion of said rear wall to facilitate mounting of said side rails to the head and base of the casing, respectively and to strengthen the side rails.

13. The side rail as claimed in claim 10 wherein said fingers further comprise side edges extending from the ends of the arcuate, concave front edge in opposite directions, said side edges tapering in the direction of said rear wall to define deflection surfaces for deflecting the flow of solids into the leading edges of the cutting elements at the ends of the fingers when facing in the upstream direction of the liquid flow during the use of the apparatus.

14. The side rail as claimed in claim 13 wherein said fingers side edges are arcuate in the direction of flow of liquid through said comminutor.

* * * * *

UNITED STATES PATENT AND TRADEMARK OFFICE

CERTIFICATE OF CORRECTION

PATENT NO. : 4,702,422

DATED : October 27, 1987

INVENTOR(S) : Joseph W. CHAMBERS et al

It is certified that error appears in the above-identified patent and that said Letters Patent is hereby corrected as shown below:

On the Title Page, Item [54]:

Please change the title from "SOLID WASTE COMMINUTOR WITH SLOTTED SLIDE RAILS AND SIDE RAILS FOR SAME" to -- SOLID WASTE COMMINUTOR WITH SLOTTED SIDE RAILS AND SIDE RAILS FOR SAME --.

Signed and Sealed this

Fifth Day of April, 1988

*Attest:*

*Attesting Officer*

DONALD J. QUIGG

*Commissioner of Patents and Trademarks*